US005894747A

United States Patent [19]

Abernathy et al.

[11] Patent Number: 5,894,747

[45] Date of Patent: Apr. 20, 1999

[54] JET DYEING MACHINE

[75] Inventors: Paul L. Abernathy; V. Gene Best, both of Dallas; Vann M. Sistare, Charlotte, all of N.C.

[73] Assignee: International Dyeing Equipment, Inc., Stanley, N.C.

[21] Appl. No.: 08/886,328

[22] Filed: Jul. 1, 1997

Related U.S. Application Data

[60] Provisional application No. 60/022,352, Jul. 24, 1996.

[51] Int. Cl.[6] ..... D06B 3/28

[52] U.S. Cl. ..... 68/178

[58] Field of Search ..... 68/177, 178

[56] References Cited

U.S. PATENT DOCUMENTS

| | | | |
|---|---|---|---|
| 3,780,544 | 12/1973 | Turner | 68/177 |
| 4,036,038 | 7/1977 | Aurich et al. | 68/178 X |
| 4,114,407 | 9/1978 | Turner et al. | 68/178 |
| 4,129,017 | 12/1978 | Greer | 68/177 |
| 4,254,644 | 3/1981 | Bartlett et al. | 68/205 |
| 4,314,464 | 2/1982 | Gran | 68/178 |
| 4,371,371 | 2/1983 | Smrekar | 8/531 |
| 4,485,508 | 12/1984 | Otting | 8/151 |
| 4,489,575 | 12/1984 | Arashi | 68/177 |
| 4,501,038 | 2/1985 | Otting | 8/151 |
| 4,547,921 | 10/1985 | Otting et al. | 8/151 |
| 4,570,464 | 2/1986 | Thompson | 68/178 |
| 4,576,020 | 3/1986 | Thurman et al. | 68/205 |
| 4,885,814 | 12/1989 | von der Eltz et al. | 8/149.1 |
| 4,903,509 | 2/1990 | Christ et al. | 68/5 |
| 4,923,743 | 5/1990 | Stewart, Jr. | 427/288 |
| 4,936,119 | 6/1990 | Thompson | 68/178 |
| 4,947,660 | 8/1990 | von der Eltz et al. | 68/177 |
| 5,014,526 | 5/1991 | Hacker et al. | 68/178 |
| 5,016,308 | 5/1991 | McBride et al. | 8/149 |
| 5,129,242 | 7/1992 | Sturkey et al. | 68/178 |
| 5,161,395 | 11/1992 | Wethington | 68/205 |
| 5,577,282 | 11/1996 | Turner et al. | 68/178 X |

FOREIGN PATENT DOCUMENTS

| | | | |
|---|---|---|---|
| 134878 | 3/1979 | Germany | 68/178 |
| 2073797 | 10/1981 | United Kingdom | 68/178 |

*Primary Examiner*—Philip R. Coe
*Attorney, Agent, or Firm*—Moore & Van Allen, PLLC

[57] ABSTRACT

An improved low liquid gentle jet dyeing machine which has a pressure vessel with one or more inner chambers located interior to and spaced from the interior edges of the pressure vessel. An endless rope of fabric is contained within each inner chamber. The fabric is plaited to form a plug in the inner chamber. A rotatable perforated barrel reel lifts the fabric from this plug through the outlet of the inner chamber. The fabric then enters a jet dyeing chamber which contains a parallel flow non-clog venturi disposed so as to gently impregnate the fabric with dye liquid. The fabric exits the jet dyeing chamber through a cloth discharge tube which is disposed to convey the fabric to the entrance of the inner chamber in such a way that the angular change of direction of the fabric is minimized. The side walls and floor of the inner chamber are perforated, with the number of side wall perforations being greater toward the chamber entrance and lesser toward the chamber outlet. As the fabric leaves the cloth discharge tube and contacts the inner chamber, the dye liquid leaves the fabric through the perforations of the inner chamber. A plastic liner is placed along the floor of the inner chamber in order to assist the movement of the plug of fabric from the entrance to the outlet of the inner chamber. The inner chamber has a cross section which increases in depth from the entrance to the outlet to allow the fabric plug to progress from the entrance to the outlet with less and less binding. Beneath the vessel is a pump suction header which maximizes the net positive suction pressure for the pump which recirculates the dye from the pressure vessel to the non-clog jet venturi.

16 Claims, 6 Drawing Sheets

JET DYEING MACHINE

CROSS REFERENCE

This application claims the benefit of U.S. Provisional Application No. 60/022,352, filed Jul. 24, 1996.

FIELD OF THE INVENTION

The present invention relates to jet dyeing machines, and more particularly to an improved low liquid ratio gentle jet dyeing machine.

BACKGROUND OF THE INVENTION

Jet dyeing machines, as representatively described in U.S. Pat. No. 3,780,544, are widely used throughout textile producing areas of the world. Although there have been advances in this art area since the early 1970's when these machines first became popular, many of the pre-1980 jet dyeing machines are still in extensive use. A representative dyeing machine of the prior art is shown in FIGS. 5 and 5A.

A jet dyeing machine made prior to 1978 typically has a pressure vessel 1 which is about seven feet in diameter. Within the pressure vessel 1 is one or more prior art inner chambers 22, each containing an endless rope of fabric 5 which is dyed as it circulates through the jet dyeing machine. The endless rope of fabric 5 is plaited or folded in the prior art inner chamber 22 and floats in a bath of dye liquid. By floating the endless rope of fabric 5 in a bath, the strain on the fabric is reduced.

The endless rope of fabric 5 is lifted from the floating plug by a lifter reel 23 contained within a lifter reel housing 6. The lifter reel 23 frequently consists of a series of spokes which catch and move the fabric as they rotate. The endless rope of fabric 5 then goes to a jet dyeing chamber 7 where a jet venturi (not shown) introduces dye liquid to the fabric. The endless rope of fabric 5 then moves to the cloth discharge tube 20 where the dye liquid and the fabric return to the prior art inner chamber 22. As shown in FIG. 5A, prior art cloth discharge tubes 20 normally require the endless rope of fabric 5 to make a sharp turn which can impede the fabric's progress as it re-enters the prior art inner chamber 22.

Dye is recirculated from an end wall pump header or opening 12 which leads to the pump and pump housing 14. The pump lifts dye liquor through the heat exchanger 15 and sends it through the manifold 16 which distributes the dye to the jet dyeing chambers 7. Each pressure vessel 1 on a prior art jet dyeing machine typically has more than one prior art inner chamber 22. For each prior art inner chamber 22 there is an associated lifter reel 23 and jet dyeing chamber 7. The prior art jet dyeing machine typically has a relatively small existing drain pipe 18 located beneath the pressure vessel 1.

These prior art jet dyeing machines have several drawbacks. First, floating the fabric in a bath of dye liquid to reduce the strain on the fabric requires a large amount of liquid relative to the amount of fabric to be dyed. The dye liquor to fabric weight ratio for most of these machines is 10:1 or more. Because the dyeing process frequently occurs under heat and pressure, the liquor volume must be heated, consuming an amount of energy proportionate to the amount of liquid contained within the vessel. At the conclusion of the dyeing process, the spent liquor is discharged as waste, incurring treatment costs proportionate to the amount of liquor in the vessel.

The older machines also often have problems with dye uniformity because the fabric rope 5 is under tension and often twisted by the lifter reel 23, by the jet venturi, or by the sharp turn that the fabric makes as it moves through the cloth discharge tube 20. This causes the dye in the jet to permeate the fabric rope unevenly. Fabric twists and tangles further complicate the dyeing process because they require shutdown of the machine in order to physically untangle the fabric. Moreover, all of the stresses and strains which are caused by prior art jet dyeing machines may damage light, more delicate fabrics by abrading the fabric.

SUMMARY OF THE INVENTION

The primary object of this invention is to provide a cost-effective conversion to pre-1978 jet dyeing machines to improve dye/fabric economics and quality. A further objective is to lower the liquid to fabric weight ratio to minimize water consumption, reduce treatment costs, and improve energy efficiency. A further object is to provide an apparatus which will provide good dye uniformity and reduce abrasion and scuffing of the fabric's surface.

The improved low liquid gentle jet dyeing machine of this invention has a pressure vessel with one or more inner chambers located interior to and spaced from the interior edges of the pressure vessel. An endless rope of fabric is contained within each inner chamber. This endless rope of fabric is plaited to form a plug in the inner chamber. The endless rope of fabric rises from this plug at the outlet of the inner chamber to a rotatable perforated barrel reel. This rotatable perforated barrel reel is driven to lift the endless rope of fabric from the plaited plug. From the rotatable perforated barrel reel, the rope of fabric enters a jet dyeing chamber. The jet dyeing chamber contains a parallel flow non-clog venturi disposed so as to gently impregnate the rope of fabric with the dye liquid. The flow from the jet also helps to move the rope of fabric along. The rope of fabric exits the jet dyeing chamber through a cloth discharge tube. The cloth discharge tube is disposed to receive the fabric from the jet chamber and convey the fabric to the inner chamber's entrance in such a way that the angular change of direction of the fabric is minimized. The inner chamber has side walls and a floor. The side walls and floor are perforated, with the number of side wall perforations being greater toward the chamber entrance and lesser toward the chamber outlets. As the rope of fabric leaves the cloth discharge tube and contacts the upper end of the inner chamber's entrance, the dye liquid leaves the fabric through the perforations of the inner chamber. A plastic liner is placed along the floor of the inner chamber at a distance back from the entrance in order to assist the movement of the plug of fabric from the entrance to the outlet of the inner chamber. The inner chamber has a cross section which increases in depth from the entrance to the outlet to allow the fabric plug to progress from the entrance to the outlet with less and less binding. Beneath the vessel is a pump suction header which maximizes the net positive suction pressure for the pump which recirculates the dye from the space between the inner chamber and the pressure vessel's inner wall to the non-clog jet venturi.

BRIEF DESCRIPTION OF THE DRAWINGS

The present invention will be more fully understood by reference to the following detailed description when considered in conjunction with the following drawings wherein like reference numbers denote the same or similar portions or processes shown throughout the several Figures, in which.

DETAILED DESCRIPTION OF THE INVENTION

The improved jet dyeing machine of this invention retains many of the characteristics and features of prior art machines but incorporates certain substantial improvements which together result in less abrasion on fabric with good dyeing characteristics while using a low dye liquor to fabric weight ratio. While this detailed description describes retrofitting existing jet dyeing machines, it is readily understood that a new jet dyeing machine may be fabricated in accordance with the teachings of this invention which new machine will share the improved characteristics described herein.

This invention improves the prior art jet dyeing machines by incorporating changes in the associated overhead piping to reduce wear on the fabric, changes to the inner chambers to allow the endless rope of fabric to move smoothly and steadily through the inner chamber, while allowing the dye liquor to readily separate from the endless rope of fabric. It also incorporates changes in the return piping to facilitate the rapid removal of dye liquor from the pressure vessel in order to allow a reduced dye liquor to fabric weight ratio.

Figure 1:
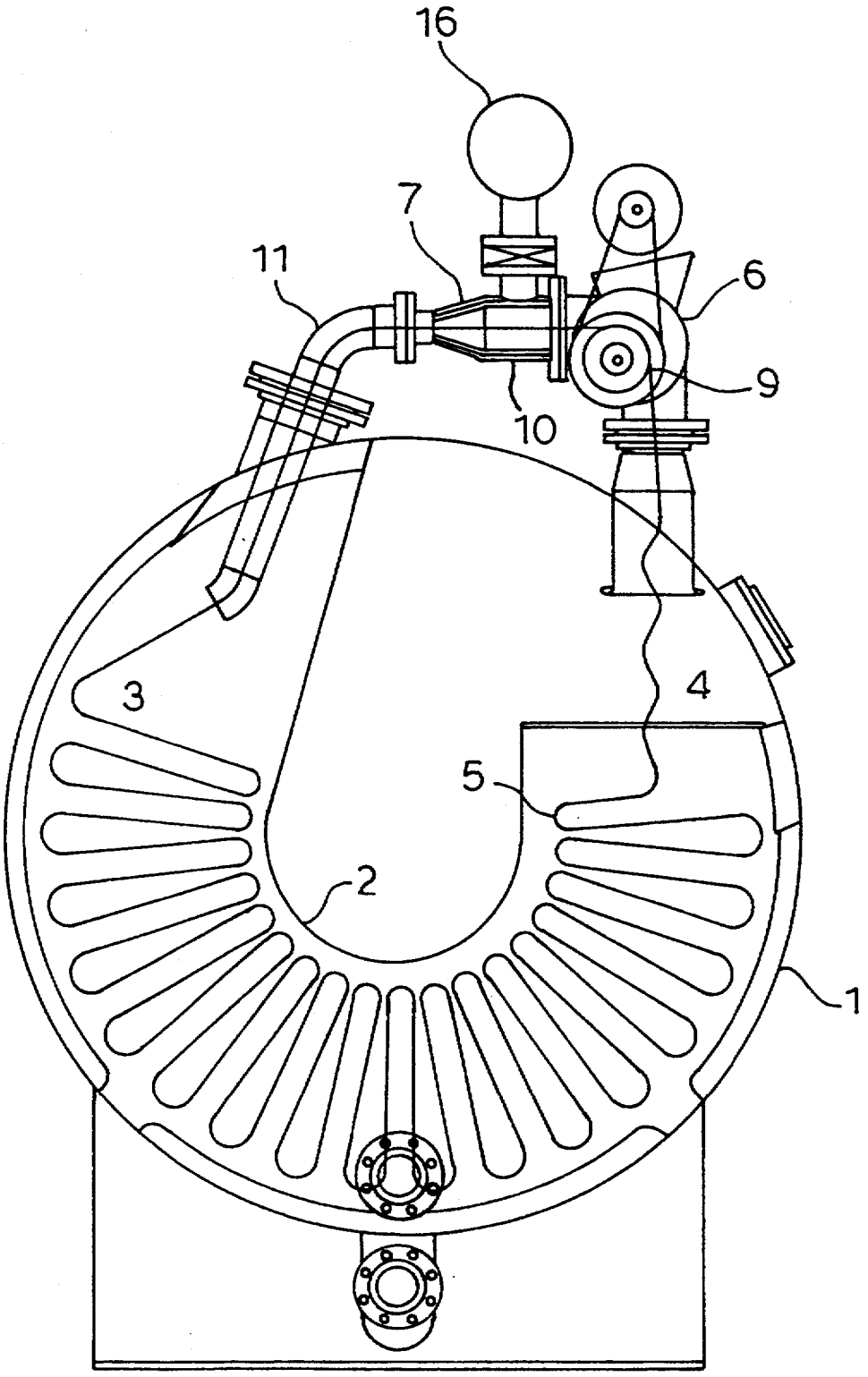
FIG. 1 is a cross-section of a representative jet dyeing machine embodying the present invention.
Figure 2:
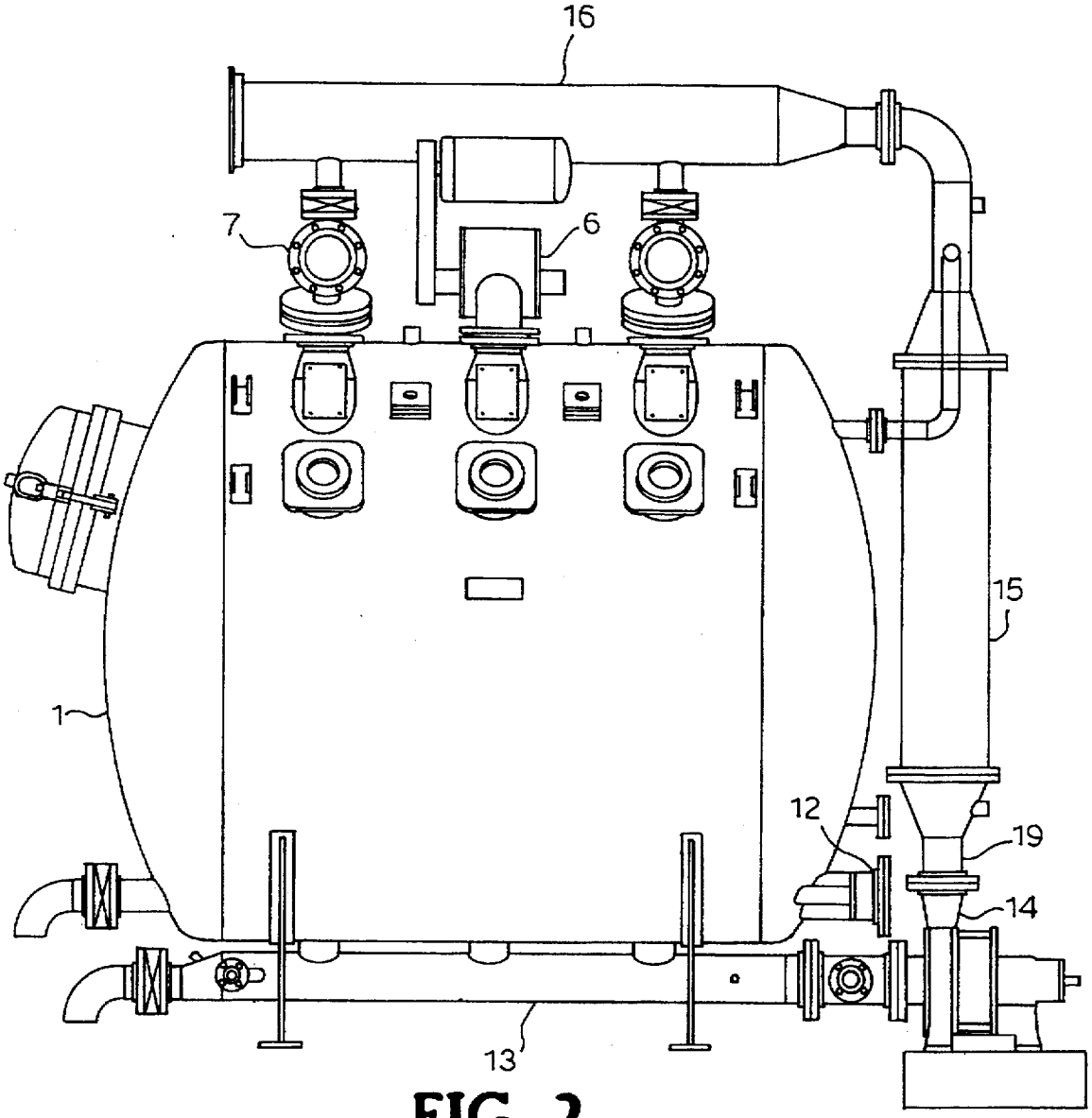
FIG. 2 is a side view of the representative jet dyeing machine of the present invention.

The improved jet dyeing machine of the present invention is depicted in FIGS. 1 and 2. It has a pressure vessel 1 with one or more inner chambers 2 located interior to and spaced from the interior edges of the pressure vessel 1. An endless rope of fabric 5 is contained within each inner chamber 2. This endless rope of fabric 5 is plaited to form a plug in the inner chamber 2. The endless rope of fabric 5 is lifted from this plug through the outlet 4 of the inner chamber 2 by a rotatable perforated barrel reel 9 instead of the lifter reel 23 used in many existing jet dyeing machines.

Figure 4A:
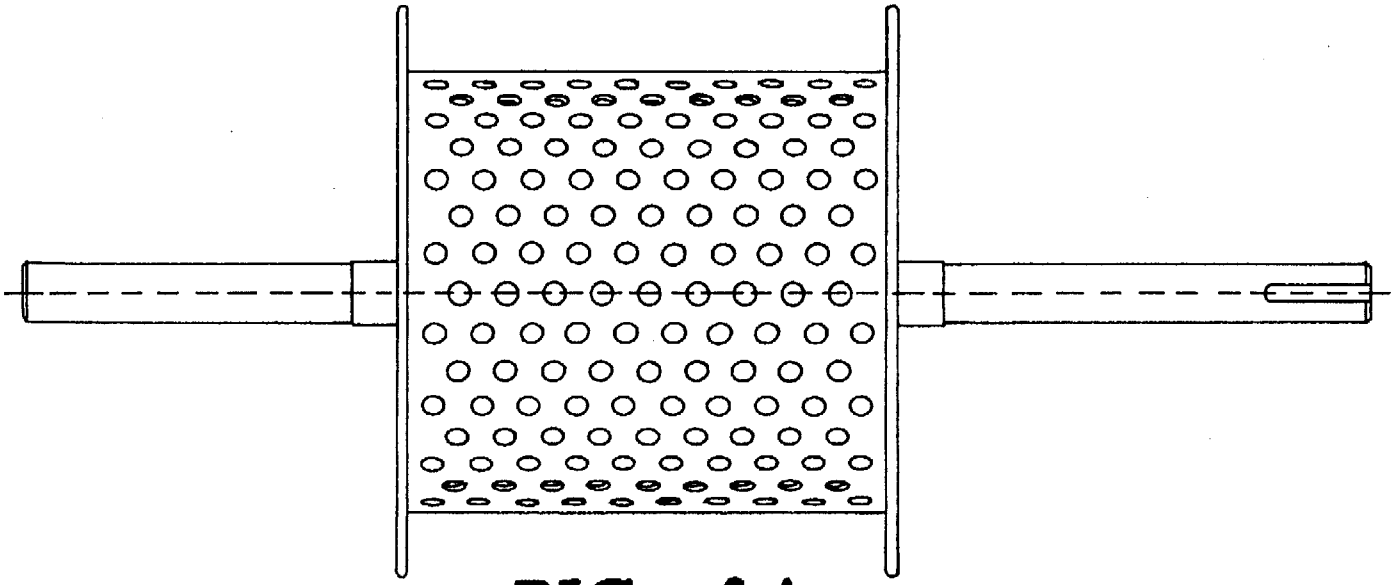
FIG. 4A is a side view of the rotatable perforated barrel reel of the invention.
Figure 4B:
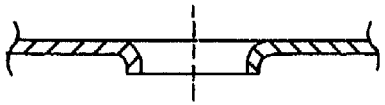
FIG. 4B is a cross-section of a perforation of the rotatable perforated drum of the invention.
Figure 5:
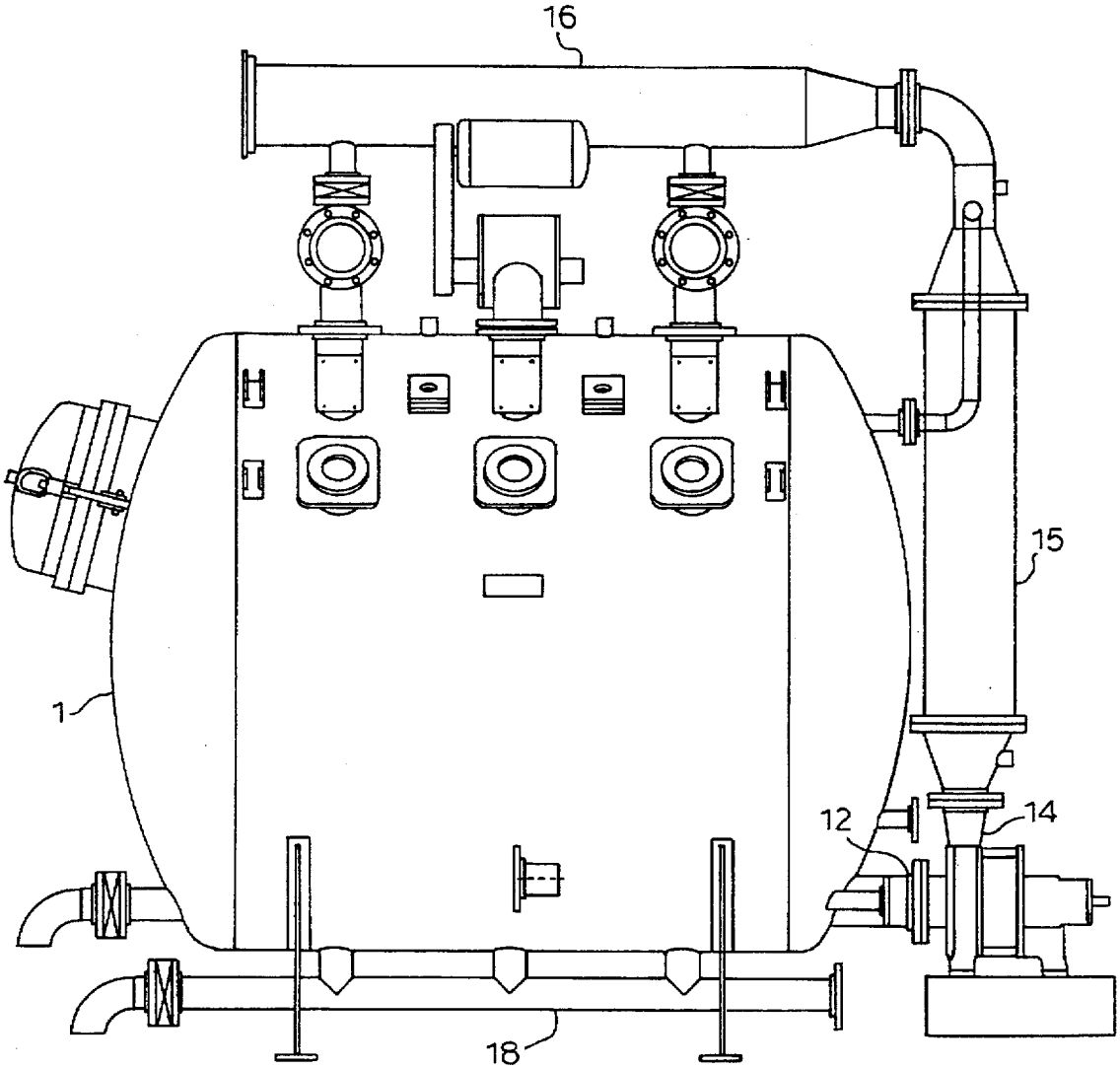
PRIOR ART FIG. 5
FIG. 5 is a side view of a typical prior art jet dyeing machine.
Figure 5A:
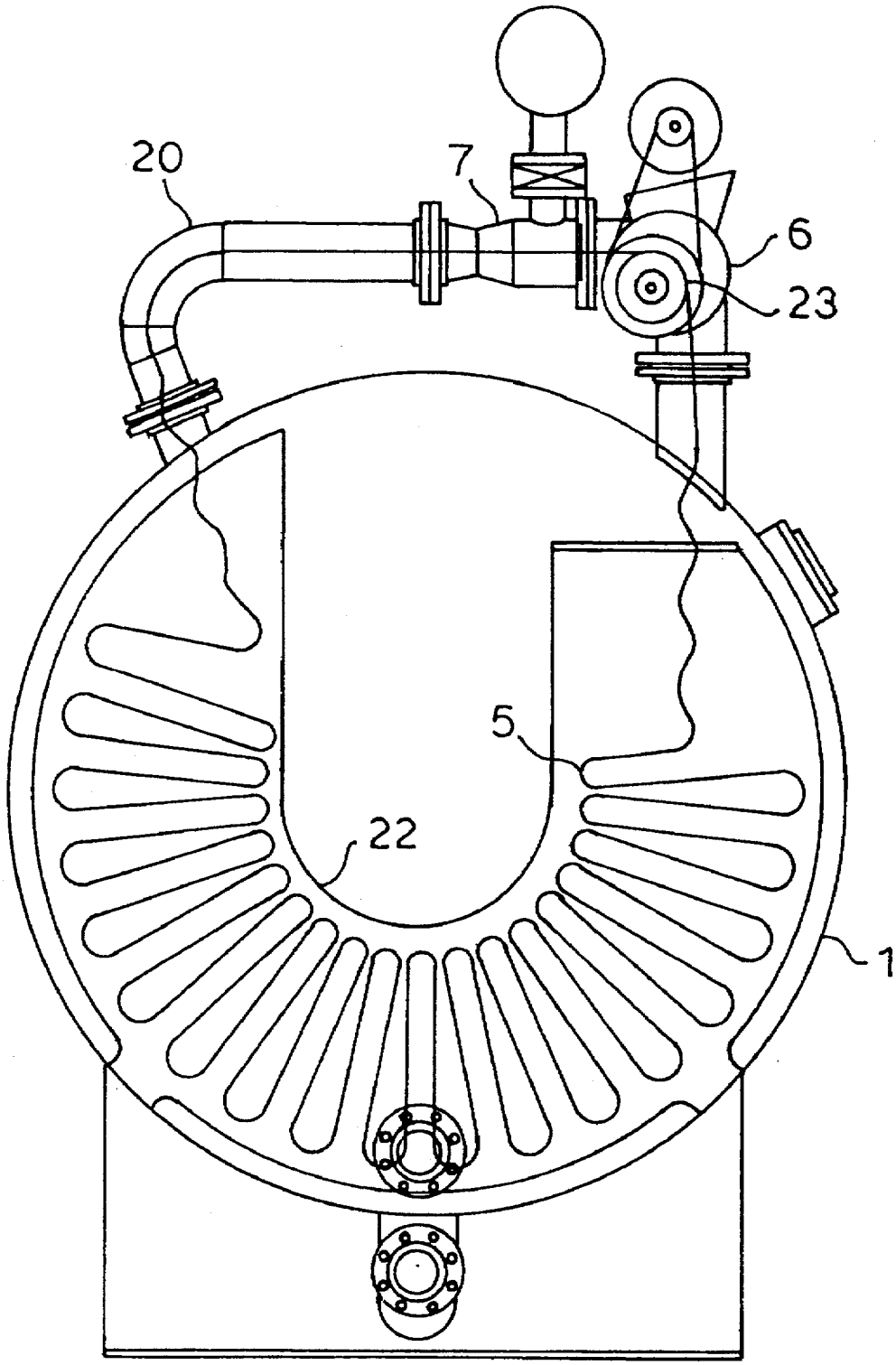
PRIOR ART FIG. 5A
FIG. 5A is a cross-section of a typical prior art dyeing machine.

FIG. 4A shows a side view of the perforated barrel reel 9 of this invention. By using a relatively smooth flat surface, the rotatable perforated barrel reel 9 of this invention is able to lift the endless rope of fabric 5 from the outlet 4 of the inner chamber 2 with little stress or twist imparted to the fabric. FIG. 4B shows a cross-section of the perforations of the rotatable perforated barrel reel 9. In the preferred embodiment, these perforations have a slight dimple or indentation to them which helps the perforated barrel reel 9 smoothly move the fabric without snagging it. Other acceptable perforation details are readily apparent to one skilled in the art, including a flat profile perforation. The perforated barrel reel 9 in the preferred embodiment is sized to fit the existing lifter reel housing 6 in existing jet dyeing machines. It is connected to a motor or other drive mechanism in such a fashion that it rotates and advances the endless rope of fabric. In new machines, this rotatable perforated barrel reel 9 and its associated housing 6 may be sized variously according to the needs of the end user.

As shown in FIG. 1, the endless rope of fabric 5 is propelled by the rotatable perforated barrel reel 9 into a jet dyeing chamber 7. The jet dyeing chamber 7 contains a parallel flow non-clog jet venturi 10. Although other ventura may be used, in the preferred embodiment a jet venturi of the type described in U.S. Pat. No. 4,570,464 is used. The non-clog jet venturi 10 is disposed so as to gently impregnate the endless rope of fabric 5 with the dye liquid without causing any substantial twisting or abrasion of the fabric. The flow from the jet venturi 10 also helps to move the endless rope of fabric 5 along. In a retrofit situation, the existing jet dyeing chamber 7 of the machine is retained, but the existing jet venturi is replaced with the non-clog jet venturi 10. In new machines, the chamber 7 may be sized to fit the new jet venturi 10.

The endless rope of fabric 5 exits the jet dyeing chamber 7 through a cloth discharge tube 11. In the preferred embodiment of a retrofit on the existing jet dyeing machine, the existing cloth discharge tube 20 is replaced by a new cloth discharge tube 11. The new cloth discharge tube 11 is configured so as to minimize the change in angular direction of the fabric as it leaves the jet dyeing chamber 7. In retrofit operations, this is accomplished by beginning the change of direction in the new cloth discharge tube 11 immediately as the fabric exits the jet dyeing chamber 7. On a new machine, this feature can be built into the piping arrangement. The importance of beginning the angle immediately after the jet dyeing chamber is to reduce this change in angular direction without having to replace significant parts of the existing jet dyeing machines. As shown in FIG. 1, the change in angular direction of the fabric as it leaves the jet dyeing chamber 7 is preferably less than 90°.

Figure 3A:
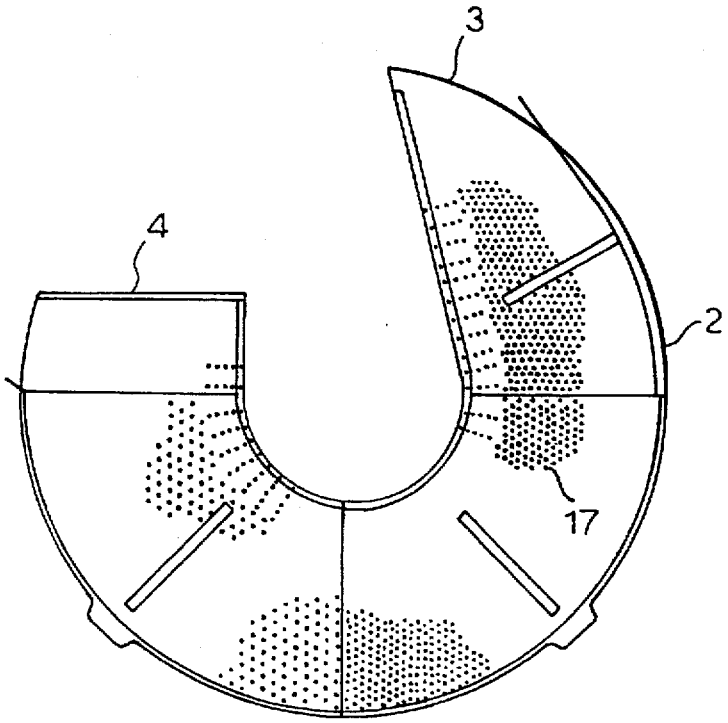
FIG. 3A is a side view of the inner chamber.

The endless rope of fabric 5 leaves the cloth discharge tube 11 and falls into the entrance 3 to the inner chamber 2. The inner chamber 2 of the current invention has a series of perforations 17 in its side walls and floor through which the dye liquid exits the inner chamber 2. FIG. 3A depicts the inner chamber 2 of the present invention. The perforations 17 in the walls and floor of the inner chamber 2 are more dense near the entrance 3 to the inner chamber 2 than they are toward the outlet 4 of the inner chamber 2. This dense pattern of perforations 17 allows the dye liquor to more readily separate from the fabric and be recirculated. The impact of the fabric on the wall of the inner chamber 2 further assists in the removal of the dye liquor from the fabric.

Figure 3B:
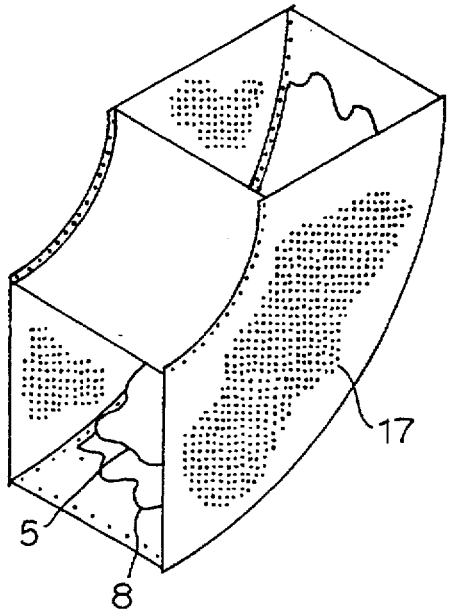
FIG. 3B is a cross-section of the inner chamber showing the liner.

The fabric then falls in folds and becomes part of the plug of fabric within the inner chamber 2. This plug advances along through the inner chamber 2 aided by a liner 8 which is on the floor of the inner chamber 2. FIG. 3B is a cross-section view of the inner chamber 2 showing the liner 8. The liner 8 is made of some smooth slick material, preferably polytetrafluoroethylene (PTFE). The liner 8 preferably covers most of the floor of the inner chamber 2 with the exception of a narrow space left between the liner 8 and the side wall, which space aids the dye liquor in exiting from the inner chamber 2 of the jet dyeing machine. The space is sized so that at least some of the perforations in the floor of the inner chamber 2 are exposed and is sufficiently large to allow the dye liquor to freely flow out. In the preferred embodiment, the space is between one and two inches and is maintained by spacers attached to the pressure vessel 1, although other arrangements are readily apparent to one skilled in the art.

The inner chamber 2 is also configured so that its cross-sectional area increases as the plug of fabric moves from the entrance 3 of the inner chamber 2 toward the outlet 4 of the inner chamber 2. This increasing cross-sectional area allows the fabric plug to progress from the entrance 3 to the outlet 4 with less and less binding. If multiple inner chambers 2 are in use in the jet dyeing machine, these inner chambers 2 are also spaced so that there is a gap between each inner chamber 2 which further allows dye liquor to exit from the fabric. In the preferred embodiment, this gap is approximately one to two inches. All of these changes in combination help the plug of fabric easily move through the inner chamber even though it is not floating in a bath of dye liquid. The arrangement also assists in removing the dye liquor from the plug of material.

In the retrofit of an existing jet dyeing machine, the present invention removes the existing drain piping 18 and replaces it with a new pump suction header 13. As shown in FIG. 2, this new pump suction header 13 is typically larger than the existing drain piping and serves two functions. It serves as a drain pipe, but also serves as the pump header for the pump intake housing 14. The existing drain openings on an existing pressure vessel 1 may be used, or new drain openings may be made in the bottom of the pressure vessel 1. In the preferred embodiment, the connections between the new pump suction header 13 and the pressure vessel 1 have openings at least 150% as large as the diameter of the pump head. A new pump suction header 13 on a retrofit from an existing jet dyeing machine is sized to match the header on the existing pump. In a retrofit, the old end wall pump header 12 is capped and the pump housing 14 is lowered to be in line with the new pump suction header 13. Some additional piping 19 is necessary to lower the existing pump housing 14 to align it with the pump suction header 13. By lowering the pump header, more of the dye liquor can be removed from the pressure vessel 1 more rapidly because the net positive suction pressure for the pump is maximized.

By rapidly removing dye liquor from the fabric and recirculating it through the pump to the jet venturi, the present invention keeps the dye liquor to fabric ratio extremely low. In addition, the changes made to the inner chamber 2, the use of a rotatable perforated barrel reel 9, the use of a non-clog high flow jet venturi 10, and the changes made to the cloth discharge tube 11 all help move the fabric through the jet dyeing machine in a fashion that results in little abrasion to the fabric, and virtually tangle-free dyeing process. Some or all of these features may be used in retrofits of existing jet dyeing machines or in new jet dyeing machines to achieve superior performance.

While the improved jet dyeing machine herein described constitutes the preferred embodiment of the present invention, it is to be understood that the invention is not limited to this precise form of apparatus, and that changes may be made therein without departing from the scope of the invention which is defined in the following claims.

We claim:

1. A jet dyeing machine, comprising:

a) a pressure vessel;

b) an inner chamber within the pressure vessel for receiving an endless rope of fabric, said inner chamber having an outlet, an entrance, side walls, and a floor, the side walls and floor having a plurality of perforations through which dye liquid may exit the inner chamber, wherein the perforations are more dense near the entrance to the inner chamber than they are toward the outlet of the inner chamber;

c) a jet dyeing chamber;

d) means for lifting the fabric from the outlet of the inner chamber and advancing it into the jet dyeing chamber;

e) a jet venturi disposed within the jet dyeing chamber for applying dye to the fabric; and f) means for transporting the fabric from the jet dyeing chamber to the entrance of the inner chamber with a total change in angular direction of less than 90°.

2. A jet dyeing machine as recited in claim 1, wherein said means for lifting the fabric through the outlet of the inner chamber and advancing the fabric into the jet dyeing chamber comprises a rotatable barrel reel.

3. A jet dyeing machine as recited in claim 2, wherein the rotatable barrel reel has a plurality of perforations.

4. A jet dyeing machine as recited in claim 3, wherein each of the perforations is indented so as to avoid snagging the fabric.

5. A jet dyeing machine as recited in claim 1, wherein the jet venturi is a parallel flow non-clog jet venturi.

6. A jet dyeing machine as recited in claim 1, wherein said means for transporting the fabric from the jet dyeing chamber to the entrance of the inner chamber comprises a cloth discharge tube connected to the jet dyeing chamber at one end and to the entrance of the inner chamber at the other end, said cloth discharge tube beginning its change of angular direction immediately adjacent the jet dyeing chamber.

7. A jet dyeing machine as recited in claim 1, wherein the cross-sectional area of the inner chamber increases from the entrance to the outlet, thereby facilitating the movement of the fabric from the entrance to the outlet.

8. A jet dyeing machine as recited in claim 1, further comprising means for rapidly recirculating dye from the pressure vessel to the jet venturi.

9. A jet dyeing machine as recited in claim 8, wherein said means for rapidly recirculating dye from the pressure vessel to the jet venturi comprises:

a) a pump housing;

b) a pump suction header provided underneath the pressure vessel for returning dye from the pressure vessel to the pump housing; and c) a pump mounted in the pump housing for pumping dye from the pump housing to the jet venturi.

10. A jet dyeing machine, comprising:

a) a pressure vessel;

b) an inner chamber within the pressure vessel for receiving an endless rope of fabric, said inner chamber having an outlet, an entrance, side walls, and a floor, the side walls and floor having a plurality of perforations through which dye liquid may exit the inner chamber, wherein the perforations are more dense near the entrance to the inner chamber than they are toward the outlet of the inner chamber;

c) a jet dyeing chamber;

d) a rotatable perforated barrel reel for lifting the fabric from the outlet of the inner chamber and advancing it into the jet dyeing chamber;

e) a parallel flow non-clog jet venturi disposed within the jet dyeing chamber for applying dye to the fabric; and f) means for transporting the fabric from the jet dyeing chamber to the entrance of the inner chamber with a total change in angular direction of less than 90°.

11. A jet dyeing machine as recited in claim 10, wherein the cross-sectional area of the inner chamber increases from the entrance to the outlet, thereby facilitating the movement of the fabric from the entrance to the outlet.

12. A jet dyeing machine as recited in claim 11, further comprising means for rapidly recirculating dye from the pressure vessel to the jet venturi.

13. A jet dyeing machine as recited in claim 12, wherein said means for transporting the fabric from the jet dyeing chamber to the entrance of the inner chamber comprises a cloth discharge tube connected to the jet dyeing chamber at one end and to the entrance of the inner chamber at the other end, said cloth discharge tube beginning its change of angular direction immediately adjacent the jet dyeing chamber.

14. A jet dyeing machine, comprising:

a) a pressure vessel;

b) an inner chamber within the pressure vessel for receiving an endless rope of fabric, said inner chamber having an outlet, an entrance, side walls, and a floor, the inner chamber having a plurality of perforations in the floor through which dye liquid may exit the inner chamber;

c) a jet dyeing chamber;

d) means for lifting the fabric from the outlet of the inner chamber and advancing it into the jet dyeing chamber;

e) a jet venturi disposed within the jet dyeing chamber for applying dye to the fabric;

f) means for transporting the fabric from the jet dyeing chamber to the entrance of the inner chamber with a total change in angular direction of less than 90°; and g) a liner provided on the floor of the inner chamber for facilitating movement of the fabric within the inner chamber, wherein a narrow space remains between the liner and the side walls of the inner chamber, which space allows dye to exit the inner chamber through the perforations in the floor.

15. A jet dyeing machine as recited in claim 14, wherein the liner is made of polytetrafluoroethylene.

16. A jet dyeing machine, comprising:

a) a pressure vessel;

b) an inner chamber within the pressure vessel for receiving an endless rope of fabric, said inner chamber having an outlet, an entrance, side walls, and a floor, the side walls and floor having a plurality of perforations through which dye liquid may exit the inner chamber, wherein the perforations are more dense near the entrance to the inner chamber than they are toward the outlet of the inner chamber;

c) a jet dyeing chamber;

d) a rotatable perforated barrel reel for lifting the fabric from the outlet of the inner chamber and advancing it into the jet dyeing chamber;

e) a parallel flow non-clog jet venturi disposed within the jet dyeing chamber for applying dye to the fabric;

f) means for transporting the fabric from the jet dyeing chamber to the entrance of the inner chamber with a total change in angular direction of less than 90°; and g) a liner provided on the floor of the inner chamber for facilitating movement of the fabric within the inner chamber, wherein a narrow space remains between the liner and the side walls of the inner chamber, which space allows dye to exit the inner chamber through the perforations in the floor.

* * * * *